US008341923B2

(12) United States Patent
Dyson et al.

(10) Patent No.: US 8,341,923 B2
(45) Date of Patent: Jan. 1, 2013

(54) PACKAGING WINDOW COVERINGS

(75) Inventors: Denise C. Dyson, Newburgh, NY (US); Michael S. Goldberg, Land O Lakes, FL (US); Terry D. Goodale, Harbor City, CA (US); Michael A. Panco, Dunedin, FL (US)

(73) Assignee: Hunter Douglas Inc., Pearl River, NY (US)

( * ) Notice: Subject to any disclaimer, the term of this patent is extended or adjusted under 35 U.S.C. 154(b) by 640 days.

(21) Appl. No.: 12/170,258

(22) Filed: Jul. 9, 2008

(65) Prior Publication Data

US 2009/0013643 A1 Jan. 15, 2009

Related U.S. Application Data

(60) Provisional application No. 60/948,538, filed on Jul. 9, 2007.

(51) Int. Cl.
*B65B 11/00* (2006.01)
*B65B 51/04* (2006.01)

(52) U.S. Cl. ..... 53/397

(58) Field of Classification Search ..... 53/397, 53/135.2, 138.2; 24/336, 531, 545, 555
See application file for complete search history.

(56) References Cited

U.S. PATENT DOCUMENTS

| | | | | | |
|---|---|---|---|---|---|
| 3,739,545 | A * | 6/1973 | Lattke | 53/456 |
| 3,771,282 | A * | 11/1973 | Flanagan | 53/574 |
| 3,986,319 | A * | 10/1976 | Puskarz et al. | 53/447 |
| 3,994,050 | A * | 11/1976 | Bub | 24/562 |
| 5,555,606 | A * | 9/1996 | Chu | 24/67.9 |
| 5,608,950 | A * | 3/1997 | Noguchi | 24/67.3 |
| 6,067,691 | A * | 5/2000 | Feltman | 24/295 |
| 6,594,973 | B1 * | 7/2003 | Alpert et al. | 53/435 |
| 2003/0062405 | A1 * | 4/2003 | Luu et al. | 229/117.33 |
| 2005/0284775 | A1 * | 12/2005 | McLaughlin et al. | 206/83.5 |

* cited by examiner

*Primary Examiner* — Rinaldi I. Rada
*Assistant Examiner* — John Paradiso
(74) *Attorney, Agent, or Firm* — Merchant & Gould

(57) ABSTRACT

A method of packing shutter panels including applying foam clips to sides of a shutter panel. The ends of the foam clips extend beyond ends of the shutter panel so that the ends of the foam clips overhang the panel. A plastic covering wrapped around the foam clips and the shutter panel is wrapped tight enough to compress and bend the ends of the foam clips inward toward the panel to form protective corners.

15 Claims, 6 Drawing Sheets

PACKAGING WINDOW COVERINGS

CROSS-REFERENCE TO RELATED APPLICATION

This application claims priority to U.S. Provisional Patent Application No. 60/948,538 entitled "METHOD AND APPARATUS FOR PACKAGING WINDOW COVERINGS" filed Jul. 9, 2007, which is hereby incorporated by reference in its entirety as if set forth herein in full.

BACKGROUND

Wood shutters (and related types of window coverings) are frequently made to order and then shipped to a retail store or a customer's location. In order to protect the valuable window coverings, the shutters are typically shipped in individual boxes with one or two panels placed in each box, wherein conventional packing materials are used to prevent shifting of the shutters within the shipping box. Individually boxing one or two shutter panels requires a large amount of packing material as well as a relatively large amount of manpower within a shipping department. Additionally, at the receiving end, the box remnants and packing material must be disposed of by the customer.

Furthermore, the use of conventional boxes poses a risk to the relatively fragile window coverings, particularly wooden shutter panels with furniture-quality finish. For example, customers receiving the shipped boxes typically utilize sharp tools to remove staples from the box and/or cut the box open. A moment of carelessness when opening the box can result in the wooden shutter being scratched or gouged.

It is with respect to these and other background considerations, limitations and problems that the present invention has been developed.

SUMMARY

Described are embodiments for packaging of shutter panels. In one embodiment, a method of packing shutter panels includes applying foam clips to opposite sides of a shutter panel. The ends of the foam clips extend beyond ends of the shutter panel so that the ends of the foam clips overhang the panel. A plastic covering is wrapped around the clips and the shutter panel. The plastic covering is wrapped tight enough so that the ends of the foam clips bend inward toward the panel to form protective corners.

Another embodiment is directed to foam clips that are used in packaging two shutter panels. The foam clips include a sidewall, opposing end walls, and an intermediate divider wall that defines two separate channels for receiving sides of the two shutter panels. In an embodiment, each of the opposing end walls defines an inner surface that is angled inward toward the divider wall to provide an interference fit with the sides of the panels. The clips are thus secured to the panels.

This Summary is provided to summarize some embodiments of the present invention that are further described below in the Detailed Description. This Summary is not intended to identify important or essential features, nor is it intended to be used to limit the scope of the claims.

DETAILED DESCRIPTION

In embodiments, the present invention provides improved packaging of window coverings. As described in detail below, embodiments of the present invention provide for the use of foam clips to efficiently and safely package window coverings for storage or shipping. The embodiment described below relates to window shutters, referred to below as "shutter panels" or simply "panels." However, the present invention is not limited to window shutters and embodiments of the invention may be used to package other window coverings such as blinds, shades or portions thereof. Moreover, the window coverings may be made from a variety of materials including, but not limited to, wood, composites, and vinyl.

Figure 1A:
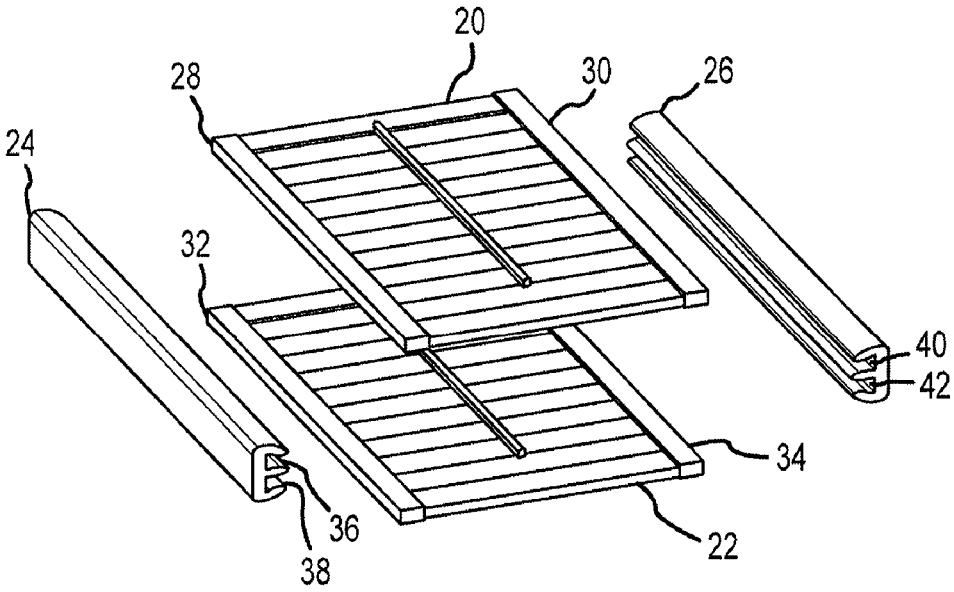
FIGS. 1A-1D illustrate an embodiment of packaging a pair of panels using a foam clip is applied to opposite sides of the pair of panels.
Figure 1B:
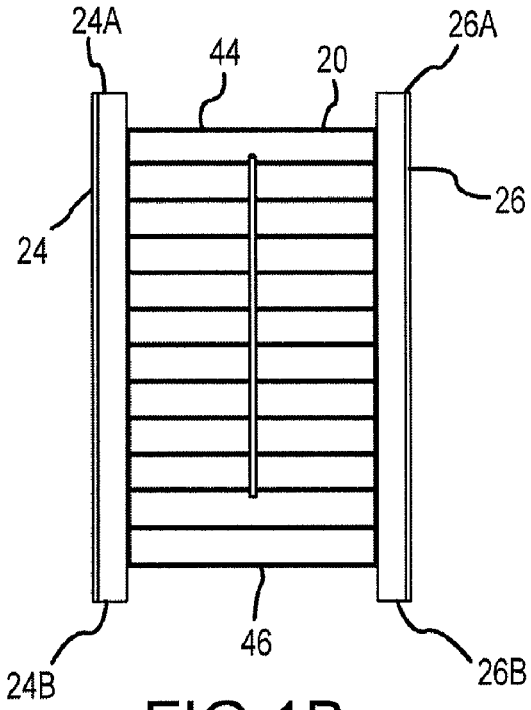
Figure 1C:
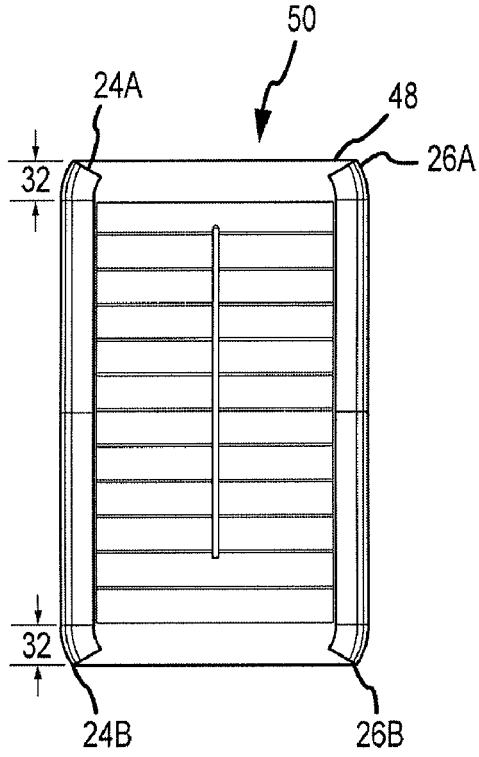

FIGS. 1A-1D illustrate a method of packaging two shutter panels 20 and 22 using foam clips 24 and 26. As illustrated in FIGS. 1A-1C, foam clips 24 and 26 are applied to sides of shutter panels 20 and 22, e.g., along the long dimension of the panels. A plastic covering 48 is applied around foam clip 24, foam clip 26, shutter panel 20, and shutter panel 22 to create packaged panels 50. FIGS. 1A-1C are described in greater detail below.

FIG. 1A illustrates panel 20 with side 28 and side 30. Panel 22 includes sides 32 and 34. Foam clip 24 includes two channels, channel 36 and channel 38. Foam clip 26 also includes two channels, channel 40 and channel 42. When foam clips 24 and 26 are applied to panel 20, side 28 of panel 20 is disposed within channel 36 and side 30 of panel 20 is disposed within channel 40. When foam clips 24 and 26 are applied to panel 22, side 32 of panel 22 is disposed within channel 38 and side 34 of panel 22 is disposed within channel 42.

FIG. 1B illustrates foam clips 24 and 26 applied to panels 20 and 22. As illustrated in FIG. 1B foam clips 24 and 26 are longer than panel 20, such that when foam clips 24 and 26 are applied to panel 20, ends 24A and 24B of foam clip 24 and ends 26A and 26B of foam clip 26 overhang panel 20, i.e., extend beyond a top end 44 an a bottom end 46 of panel 20. Although not shown in FIG. 1B, foam clips 24 and 26 are also longer than panel 22, such that when foam clips 24 and 26 are applied to panel 22, ends 24A and 24B of foam clip 24 and ends 26A and 26B of foam clip 26 overhang extend beyond a top end and a bottom end of panel 22.

After foam clips 24 and 26 have been applied to panels 20 and 22, a protective plastic covering 48 is wrapped around foam clip 24, foam clip 26, panel 20, and panel 22 to create packaged panels 50 as shown in FIG. 1C. In particular, FIG. 1C illustrates that the plastic covering 48 is tight enough so that ends 24A and 24B of foam clip 24 and ends 26A and 26B of foam clip 26 are compressed and bent inward to form protective corners. While a stretch wrap process can be used to wrap the plastic covering 48 around the foam clips 24 and 26 and panels 20 and 22, any other process, such as a shrink wrap process may also be used, so long as a sufficient force is applied to bend ends 24A and 24B of foam clip 24 and ends 26A and 26B of foam clip 26 as shown in FIG. 1C.

Figure 1D:
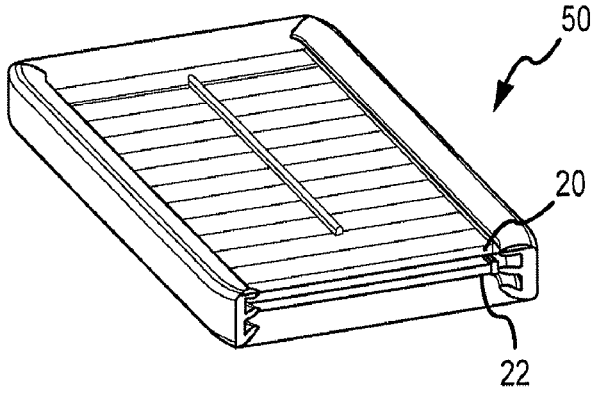

The bent corners provide impact buffer zones 32 at each end of the packaged panels 50 so that any impact will be absorbed by bent ends 24A, 24B, 26A, and 26B. Indeed, only impacts having sufficient force to fully compress one of the ends will result in contact with the shutter panels 20 or 22. The bent ends 24A, 24B, 26A, and 26B further allow the packaged panels 50 to be stacked vertically, as shown in FIG. 1C, without concern for damaging the bottom ends of panels 20 and 22. That is, the bent ends 24A, 24B, 26A, and 26B provide support for the weight of the packaged panels 50, while the foam clips 24 and 26 provide protection from contact with adjacent packaged panels when a number of packaged panels are vertically stacked. Furthermore, the plastic covering 48 prevents contact with the front and rear faces of the panels 20 and 22, thereby further enhancing the ability to stack a number of packaged panels. FIG. 1D illustrates a perspective view of packaged panels 50 showing that both panels 20 and 22 are separated and protected within packaged panels 50.

FIGS. 1A-1D illustrate only one embodiment of a method for packaging panels. In other embodiments, a single panel or more than two panels can be packaged using the method illustrated in FIGS. 1A-1D to create packaged panel(s) that can be shipped or stored.

Figure 2A:
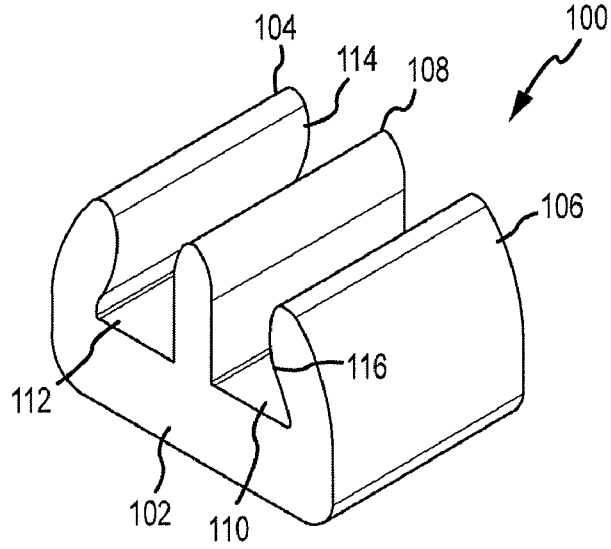
FIG. 2A illustrates an embodiment of a foam clip adapted to hold two panels.

FIG. 2A illustrates one embodiment of a portion of a foam clip 100 that may be used in the process described above with respect to FIGS. 1A-1D. In this embodiment, clip 100 includes a sidewall 102, opposing end walls 104 and 106 and an intermediate wall 108 combined as shown in FIG. 2A to define two separate channels 110 and 112 for receiving elongated sides of shutter panels, such as panels 20 and 22. End wall 104 defines an inner surface 114 that is angled inward toward the intermediate wall 108 to provide an interference fit with the sides of shutter panels, e.g., sides 28, 30, 32, and 34 (FIG. 1A). Similarly, opposing end wall 106 defines an inner surface 116 that is also angled inward toward the intermediate wall 108 to also provide an interference fit with the sides of shutter panels, e.g., sides 28, 30, 32, and 34 (FIG. 1A). In this manner, clip 100 may be secured to two shutter panels 20 and 22.

Figure 2B:
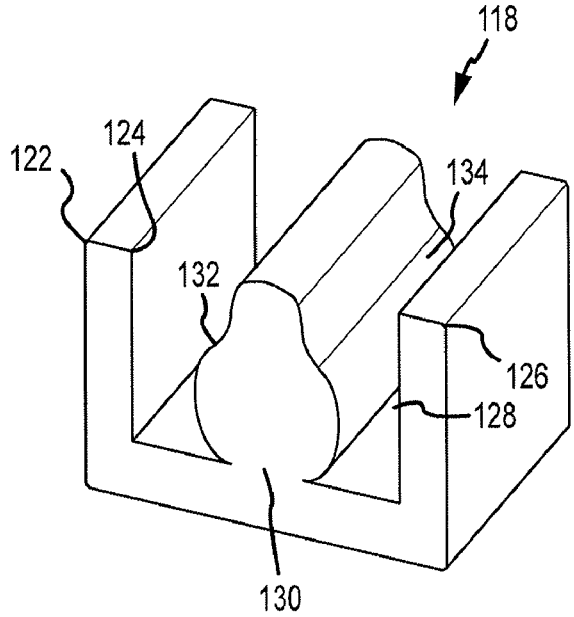
FIG. 2B illustrates another embodiment of a foam clip adapted to hold two panels.

FIG. 2B illustrates another embodiment of a foam clip 118 that may be used in the process described above with respect to FIGS. 1A-1D. Clip 118 includes similar features to foam clip 100. However, instead of opposing end walls 122 and 126 defining inner surfaces that are angled inward toward an intermediate wall 130, end walls 122 and 126 define inner surfaces 124 and 128, respectively, that are relatively straight. The intermediate wall 130 of clip 118 defines opposing outer surfaces 132 and 134 that are angled outward toward inner surfaces 124 and 128, respectively. Outer surfaces 132 and 134 create an interference fit with the sides of shutter panels, e.g., sides 28, 30, 32, and 34 (FIG. 1A).

Figure 3:
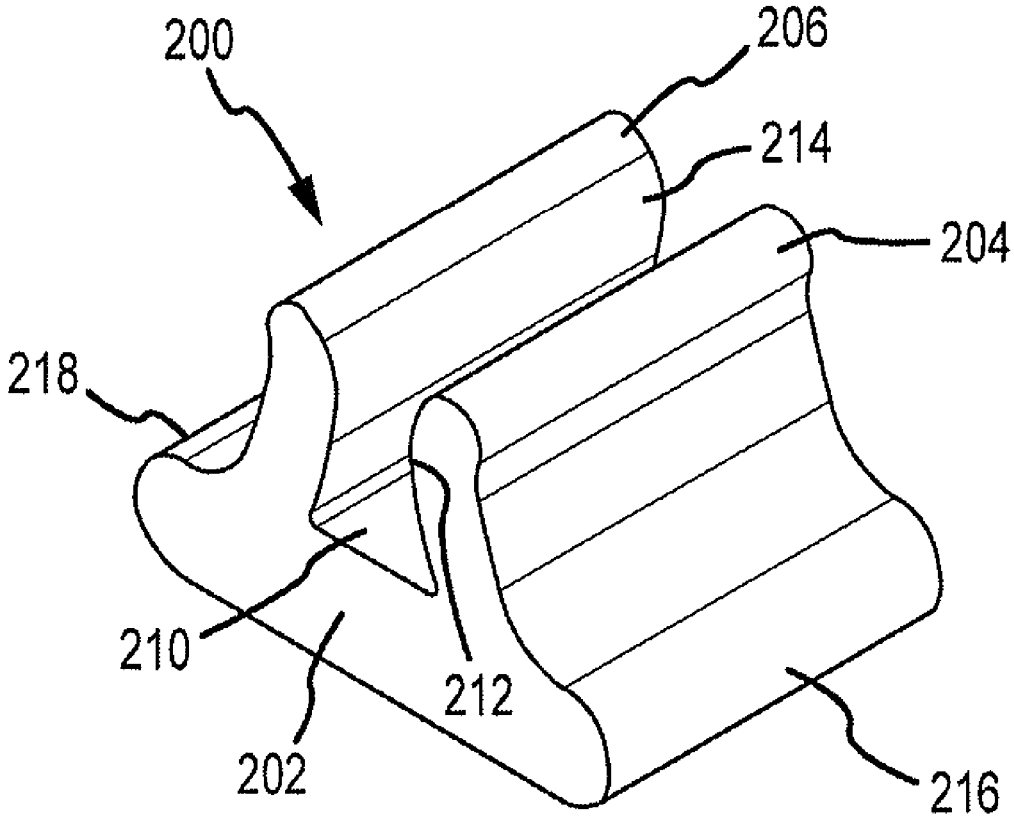
FIG. 3 illustrates a second embodiment of a foam clip adapted to hold a single panel.

While FIGS. 2A and 2B illustrate an embodiment of a foam clip that is adapted to hold two separate panels, FIG. 3 illustrates an alternative clip embodiment 200 that is adapted to hold only a single panel. In particular, the foam clip 200 includes a sidewall 202 and opposed curved walls 204 and 206 that define a single channel 210 for receiving the side of a single shutter panel. Curved wall 204 defines an inner surface 212 that is angled inward toward the channel 210. Similarly, opposed curved wall 206 defines an inner surface 214 that is angled inward toward the channel 210. The inner surfaces 212 and 214 assist in providing an interference fit with the side of a shutter panel.

In embodiments, the clip 200 also preferably includes protruding shoulders 216 and 218 that provide added protection when a packaged panel is laid flat (and that provide enhanced stability when the panels are vertically stacked, as described above). Additionally, in embodiments, protruding shoulders 216 and 218 of clip 200 provide an overall height dimension that is the same as that of clips 100 and 118 shown in FIGS. 2A and 2B. In this manner, a single packaged panel, packaged using clip 200 occupies approximately the same amount of space as a double-packaged panel using clips 100 or 118 shown in FIGS. 2A.

The embodiments described above alleviate the requirement to separately box shutter panel window coverings within a conventional cardboard box, thereby reducing the cost, waste and potential damage to shutter panels that is typically associated with conventional cardboard boxes. In particular, a recipient of a shutter panel utilizing packaging consistent with embodiments of the present invention need only cut a plastic covering (e.g., plastic covering 48 in FIG. 1A) and remove a clip (e.g., clips 24 and 26 in FIG. 1A) from one side of a packaged panel in order to access the panels. Indeed, this process is enhanced and made relatively risk-free by allowing a recipient to cut the plastic along the length of one of the clips so that the foam clip actually protects the valuable shutter panel from accidental contact with a knife. Specifically, a user may cut a predetermined distance into the foam clip without concern that the knife will contact the panel. This single-cut operation allows for a relatively quick and simple unpacking operation, and the lack of a cardboard box limits the amount of waste product that must be disposed of or recycled by the recipient.

Thus, the improved packaging of the present invention provides for faster packing and unpacking of shutter panels than is possible with conventional boxes. Furthermore, the use of foam clips that are bent at the ends provides enhanced protection for shutter panels as opposed to conventional box technology. Specifically, the present invention provides for the foam clips to substantially surround and protect all four sides of the shutter panels, and to further extend above and below the panel to provide (in conjunction with the plastic covering) protection for the front and rear surfaces of a panel.

While the above description and accompanying drawings have described the invention with respect to packaging shutter panels, the present invention is not so limited and could be utilized in other embodiments with a variety of window coverings (e.g., vinyl shutters) or related materials (e.g., railings for window shades). Additionally, while numerous embodiments of a foam clip have been disclosed, alternative embodiments may be utilized, including those that hold more than two panels. Furthermore, while the foam clips are preferably formed from a medium density (e.g., 1.8 lb) polyethylene foam, alternative materials and sizes may be utilized by those skilled in the art. Indeed, the choice of foam may be influenced by a desire to provide maximum protection and/or provide sufficient flexibility to form the bent ends during the process of wrapping the plastic cover, as described above.

Although the packaged panels 50 shown in FIGS. 1A-1D may be shipped using conventional shipping services, it is possible that a particular shipping service might require the use of an outer box covering to comply with existing standards and regulations. In those cases where an outer box is required, the present invention utilizes a unique method for placing packaged panels, e.g., packaged panels 50 shown in FIG. 1C, within an outer box. FIG. 4 illustrates a sequence according to a preferred embodiment where previously wrapped packaged panels 300 are further enclosed within a cardboard box as might be required by a particular shipping company.

Figure 4A:
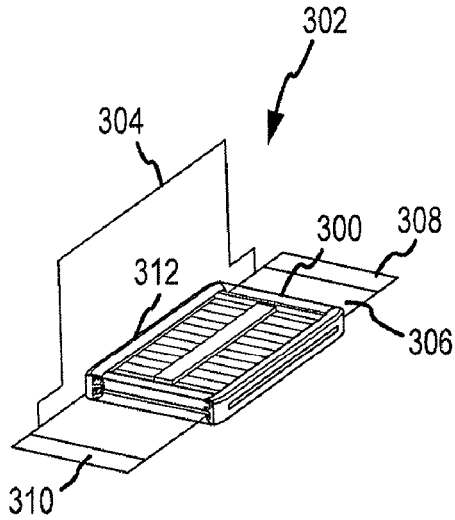
FIGS. 4A-4D illustrates an embodiment of boxing a packaged pair of panels.

As shown in FIG. 4A, packaged panels 300 are positioned with respect to a first box half 302. First box half 302 includes a side wall 304, a bottom wall 306, a first end flap 308 and a second end flap 310. Packaged panels 300 are adhered on a side to the side wall 304 with an adhesive 312. In one embodiment, the adhesive is a double sided tape, although any type of adhesive may be used as adhesive 312.

Figure 4B:
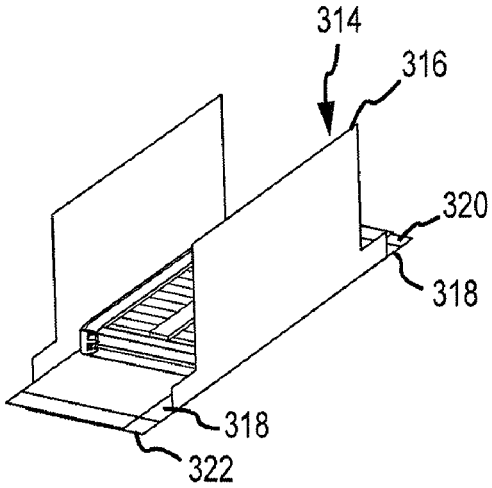
Figure 4C:
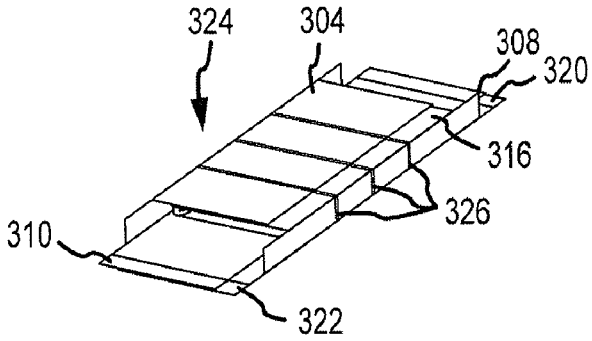

After first box half 302 is positioned, second box half 314 is positioned, as shown in FIG. 4B. Second box half 314 includes a side wall 316, a bottom wall 318, a first end flap 320 and a second end flap 322. As illustrated in FIG. 4B, second box half 314 is positioned such that the bottom wall 318 is positioned underneath bottom wall 306; the first end flap 320 is positioned underneath the first end flap 308 and the second end flap 322 is positioned under the second end flap 310. Also, although not shown, packaged panels 300 are adhered to side wall 316. Packaged panels 300 may be adhered to side wall 316 with a double sided tape or other appropriate adhesive.

Figure 4D:
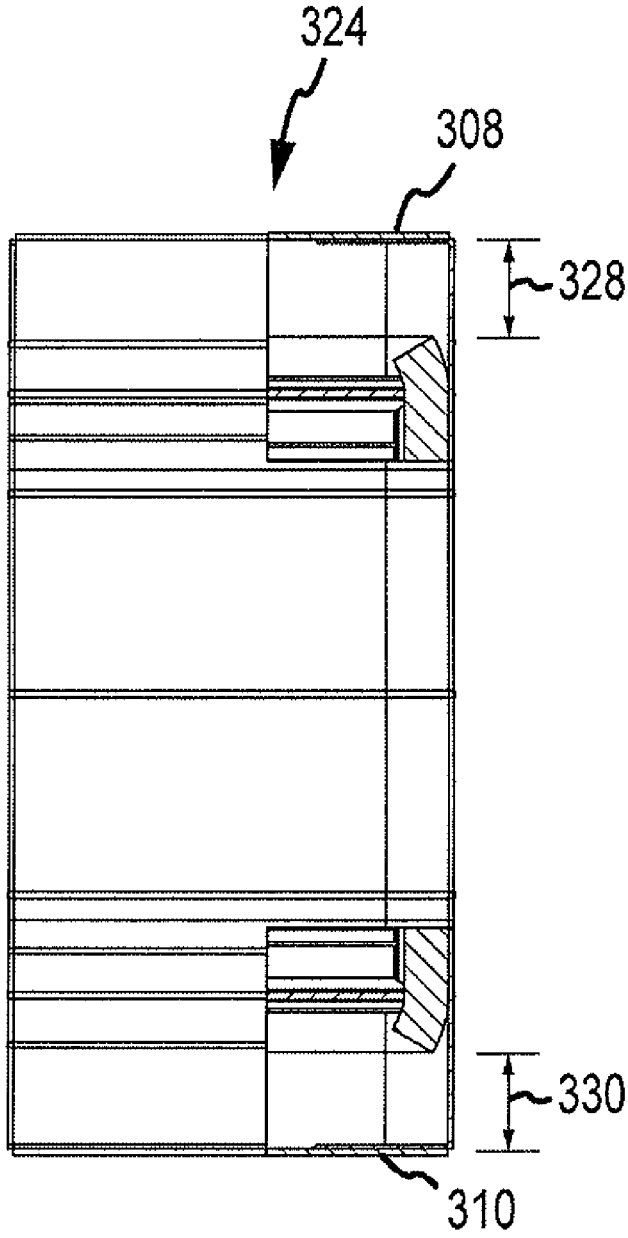

After positioning of the second box half 314, side walls 304 and 316 are closed and folded around packaged panels 300 as shown in FIG. 4D to create outer box 324. Straps 326 are wrapped around the folded side walls 304 and 306; the bottom walls 306 and 318; and the packaged panels 300. The straps have enough tension to ensure that side walls 304 and 316 are properly adhered to the corresponding sides of packaged panels 300. In this manner, packaged panels 300 "float" (i.e., remain centered) within the outer box 324 so that air gaps are provided at each end of the outer box 324. The air gaps are described further below First end flaps 308 and 320 are closed and folded around packaged panels 300. Second end flaps 310 and 322 are also closed and folded around packaged panels 300. FIG. 4D illustrates outer box 324 after end flaps, 308, 310, 320, and 322 have been closed and folded around packaged panels 300. FIG. 4D also shows two cutouts that illustrate air gaps 328 and 330. As illustrated in FIG. 4D, outer box 324 is slightly oversized which creates air gap 328 between an end of packaged panels 300 and the first end flap 308, as well as an air gap 330 between an end of packaged panels 300 and the second end flap 310. Thus, the ends of packaged panels 300 (which in and of themselves provide substantial protection to the window coverings as described above) are held above/below (in some embodiments several inches) the ends of the outer box 324 as a result of adhering the packaged panels 300 to side walls 304 and 316 to allow the packaged panels 300 to "float" within the slightly oversized outer box 324.

In sum, while the improved foam clips and plastic wrap packaging of the present invention does not require an additional outer box to adequately protect the panels (as shown in FIGS. 1A-1D), in those instances where an outer box is desired or requested by a shipping company it is desirable to secure the inner package 300 within a central portion of the outer box 324 to provide additional protection zones at each end of the box created by air gaps as shown in FIG. 4D.

While a number of preferred embodiments have been described for purposes of this disclosure, various changes and modifications may be made which are well within the scope of the present invention. For example, alternative shapes, sizes and materials may be used with the foam clips and alternative means or methods may be utilized for wrapping the plastic covering around the window covering and bending the ends of the foam clips. Furthermore, numerous other changes may be made which will readily suggest themselves to those skilled in the art and which are encompassed within the scope of the present invention.

We claim:

1. A method of packaging shutter panels, the method comprising:

applying a first foam clip to a first side of a shutter panel, the first foam clip comprising a channel within which the first side of the shutter panel is disposed, wherein the first foam clip is longer than the first side of the shutter panel such that opposing ends of the first foam clip extend beyond a top end and a bottom end of the shutter panel;

applying a second foam clip to a second side of the shutter panel opposite the first side of the shutter panel, the second foam clip comprising a channel within which the second side is disposed, wherein the second foam clip is longer than the second side of the shutter panel such that opposing ends of the second foam clip extend beyond the top end and the bottom end of the shutter panel; and applying a plastic covering around the first foam clip, the second foam clip and the shutter panel to create a packaged shutter panel, wherein the plastic covering is applied with sufficient force to bend the ends of the first foam clip and the ends of the second foam clip inward to form protective corners along the top and bottom ends of the packaged shutter panel.

2. The method of claim 1, wherein the first foam clip further comprises a second channel and the second foam clip further comprises a second channel.

3. The method of claim 2, further comprising:

applying the first foam clip to a first side of a second shutter panel, the first side of the second shutter panel being disposed within the second channel of the first foam clip, wherein the first foam clip is longer than the first side of the second shutter panel such that the opposing ends of the first foam clip extend beyond a top end and a bottom end of the second shutter panel;

applying the second foam clip to a second side of the second shutter panel opposite the first side of the second shutter panel, the second side of the second shutter panel being disposed within the second channel of the second foam clip, wherein the second foam clip is longer than the second side of the second shutter panel such that the opposing ends of the second foam clip extend beyond the top end and the bottom end of the second shutter panel; and wherein applying the plastic covering further comprises applying the plastic covering around the first foam clip, the second foam clip, the shutter panel, and the second shutter panel to create packaged shutter panels, wherein the plastic covering is applied with sufficient force to bend the ends of the first foam clip and the ends of the second foam clip inward to form protective corners along the top and bottom ends of the packaged shutter panels.

4. The method of claim 3, wherein the protective corners define impact buffer zones that absorb impact applied to the top or bottom ends of the packaged shutter panels.

5. The method of claim 3, wherein the protective corners provide support for the weight of the packaged shutter panels to allow the packaged shutter panels to be vertically stacked.

6. The method of claim 2, wherein the channel and the second channel of the first foam clip are defined by a side wall, two opposing end walls, and an intermediate wall positioned between the two opposing end walls.

7. The method of claim 1, wherein the step of applying the plastic covering comprises a stretch wrap process.

8. The method of claim 1, wherein the step of applying the plastic covering comprises a shrink wrap process.

9. The method of claim 1, wherein the first foam clip comprises a side wall and two opposing walls that define the channel of the first foam clip, each of the opposing walls defining an inner surface that angles inward toward the channel of the first foam clip to provide an interference fit with the first side of the shutter panel.

10. The method of claim 1, further comprising, after the step of applying the plastic covering:

positioning the packaged panel on a first box half, the first box half comprising a bottom wall, a first end flap, a second end flap and a side wall, wherein the packaged panel is positioned above the bottom wall;

adhering the packaged panel to the side wall of the first box half;

positioning a second box half, the second box half comprising a bottom wall, a first end flap, a second end flap and a side wall, wherein the second box half is positioned so that the bottom wall of the second box half is underneath the bottom wall of the first box half; the first end flap of the second box half is underneath the first end flap of the first box half; and the second end flap of the second box half is underneath the second end flap of the first box half;

adhering the packaged panel to the side wall of the second box half;

folding the side wall of the first box half around the packaged panel;

folding the side wall of the second box half around the packaged panel;

applying straps around the side wall of the first box half, the side wall of the second box half, the bottom wall of the first box half, the bottom wall of the second box half, and the packaged panel;

folding the first end flap of the second box half and the first end flap of the first box half around the packaged panel; and folding the second end flap of the second box half and the second end flap of the first box half around the packaged panel.

11. The method of claim 10, wherein the adhering steps comprise use of double sided tape.

12. The method of claim 10, wherein the folding the first end flap of the second box half and the first end flap of the first box half around the packaged panel comprises creating a first air gap between the packaged panel and the first end flap of the first box half.

13. The method of claim 12, wherein the folding the second end flap of the second box half and the second end flap of the first box half around the packaged panel comprises creating a second air gap between the packaged panel and the second end flap of the first box half.

14. The method of claim 1, wherein the protective corners define impact buffer zones that absorb impact applied to the top or bottom ends of the packaged shutter panel.

15. The method of claim 1, wherein the protective corners provide support for the weight of the packaged shutter panel to allow the packaged shutter panel to be vertically stacked.

* * * * *